US007992645B2

(12) United States Patent
Themig

(10) Patent No.: US 7,992,645 B2
(45) Date of Patent: Aug. 9, 2011

(54) CUT RELEASE SUB AND METHOD

(75) Inventor: Daniel Jon Themig, Cochrane (CA)

(73) Assignee: Packers Plus Energy Services Inc., Calgary (CA)

( * ) Notice: Subject to any disclaimer, the term of this patent is extended or adjusted under 35 U.S.C. 154(b) by 550 days.

(21) Appl. No.: 12/062,424

(22) Filed: Apr. 3, 2008

(65) Prior Publication Data

US 2009/0205835 A1 Aug. 20, 2009

Related U.S. Application Data

(60) Provisional application No. 61/030,121, filed on Feb. 20, 2008.

(51) Int. Cl.
*E21B 29/10* (2006.01)

(52) U.S. Cl. ..... 166/380; 166/298

(58) Field of Classification Search ..... 166/380, 166/298, 117.6, 50, 313, 242.1, 242.5
See application file for complete search history.

(56) References Cited

U.S. PATENT DOCUMENTS

| | | | | |
|---|---|---|---|---|
| 3,231,019 | A * | 1/1966 | Clay et al. | 166/287 |
| 3,313,352 | A * | 4/1967 | Tennison, Jr et al. | 166/202 |
| 5,174,340 | A * | 12/1992 | Peterson et al. | 138/110 |
| 6,073,697 | A | 6/2000 | Parlin et al. | |
| 6,076,602 | A | 6/2000 | Gano et al. | |
| 6,279,659 | B1 * | 8/2001 | Brunet | 166/313 |
| 6,386,287 | B2 * | 5/2002 | George | 166/285 |
| 6,550,539 | B2 * | 4/2003 | Maguire et al. | 166/380 |
| 6,929,063 | B2 | 8/2005 | Reese et al. | |
| 7,077,210 | B2 * | 7/2006 | MacKay et al. | 166/380 |
| 7,303,016 | B2 * | 12/2007 | Kristiansen | 166/297 |
| 7,373,990 | B2 * | 5/2008 | Harrall et al. | 166/380 |
| 7,703,538 | B2 * | 4/2010 | Johnson et al. | 166/375 |
| 2005/0011643 | A1 * | 1/2005 | Slack et al. | 166/242.1 |
| 2005/0115717 | A1 * | 6/2005 | Hall et al. | 166/380 |
| 2005/0167114 | A1 * | 8/2005 | Smith et al. | 166/313 |
| 2006/0118296 | A1 * | 6/2006 | Dybevik et al. | 166/242.1 |
| 2006/0231258 | A1 | 10/2006 | Head et al. | |
| 2007/0256841 | A1 | 11/2007 | Galloway | |

* cited by examiner

*Primary Examiner* — Daniel P Stephenson

(74) *Attorney, Agent, or Firm* — Bennett Jones LLP

(57) ABSTRACT

A tubular member for lining a wellbore, the tubular member comprising: an inner tubular member including a first end, an opposite end, an axial bore extending from the first end to the opposite end and an outer surface; an outer tubular including a base end and an outboard end, the outer tubular connected about the inner tubular adjacent its base end and a locating profile in the axial bore of the inner tubular.

40 Claims, 2 Drawing Sheets

CUT RELEASE SUB AND METHOD

FIELD

The present invention relates to downhole tubulars and methods. In particular, the present invention relates to downhole liners and methods for removing liner portions from wellbore installments.

BACKGROUND

In downhole liner systems, the liner may extend through a considerable portion of the open hole. In such systems the presence of the liner may be problematic if it is desired to create a lateral from the well.

SUMMARY

In accordance with a broad aspect of the present invention, there is provided a method for removing a liner segment in a wellbore, the method comprising: providing along the liner a cuttable portion including an inner liner tube and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower end of the tubular; and removing the upper portion from the well to expose the open hole above the upper end of the outer tubular.

In accordance with another broad aspect of the present invention, there is provided a tubular member for lining a wellbore, the tubular member comprising: an inner tubular member including a first end, an opposite end, an axial bore extending from the first end to the opposite end and an outer surface; an outer tubular including a base end and an outboard end, the outer tubular connected about the inner tubular adjacent its base end and a locating profile in the axial bore of the inner tubular.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1:
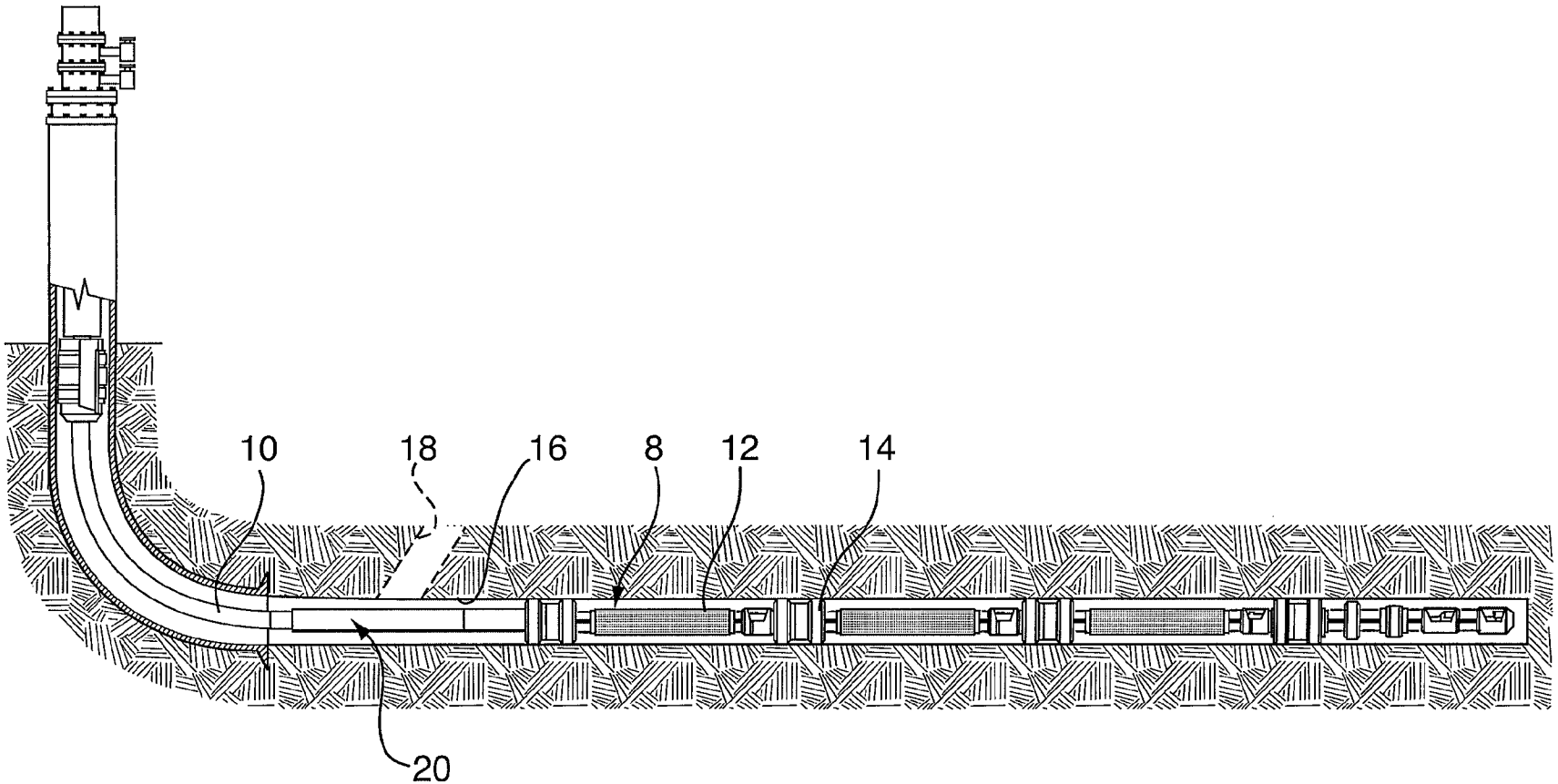
FIG. 1 is a schematic sectional view through a lined wellbore.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

With reference to FIG. 1 a lined wellbore may include a liner 8 in various forms including, for example, solid walled liners 10, screens 12, packers 14, etc. The liner 8 is placed in an open hole wellbore 16 and often extends from above the casing point down into the wellbore. Packers 14 may be set downhole to secure the liner in place in the well and to create isolated regions therewithin. In some cases, it is desirable to form a lateral wellbore, such as that shown in phantom at 18, from wellbore 16. However, liner 8 may prevent access to the open hole wellbore 16 wall such that drilling the lateral is rendered difficult.

In order to allow access to open hole wellbore 16, a cut release sub 20 may be provided along a liner such as, for example, liner 8. Cut release sub may provide a site through which a portion of the liner may be removed to expose the open hole, while leaving a lower portion of the liner in the well. Sub 20 also leaves an end of the liner lower portion open for reconnection to a string lowered from above, if that is desired. The lower portion of the liner may be anchored in the well, as by annular cementing, packers (as shown), etc.

Figure 2:
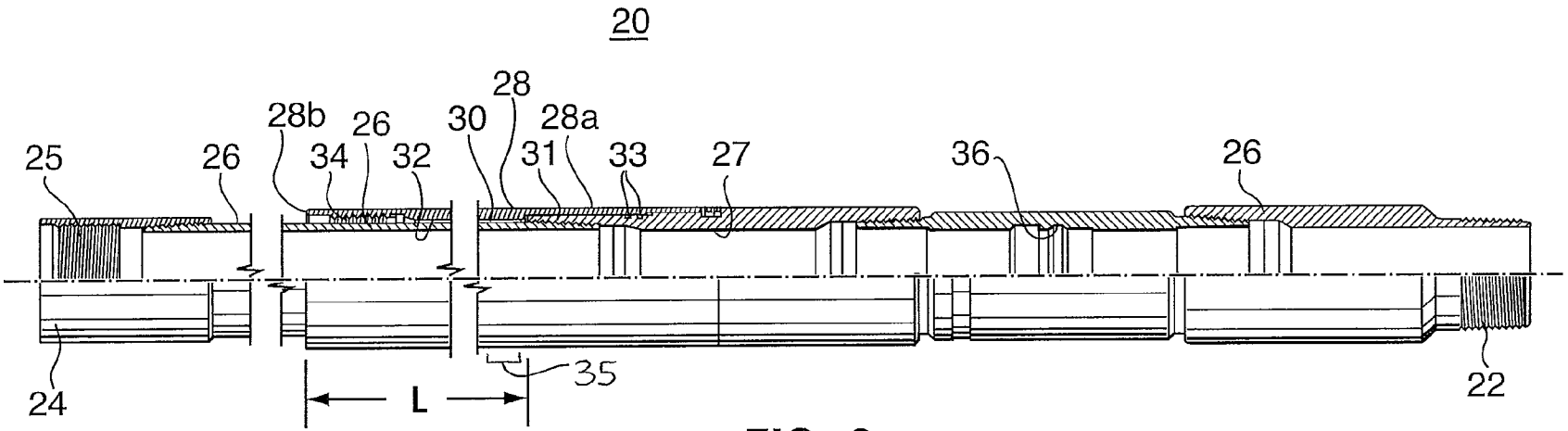
FIG. 2 is quarter axial sectional view along a cut release sub according to one aspect of the present invention.

With reference to FIG. 2, one possible embodiment of a cut release sub 20 is shown. Cut release sub 20 in the illustrated embodiment includes a tubular that may be secured in line with the tubulars of a liner string, such as that shown in FIG. 2. Cut release sub 20 may operate as a portion of the liner. In one embodiment, for example, sub 20 includes a lower end 22 for connection to a tubular string therebelow and an upper end 24 for connection to an upper tubular string. Ends 22, 24 may be formed in various ways for connection into the liner such as, for example, threaded ends such as threaded pin end, as shown at 22, and/or a box ends, as shown by reference numeral 25.

The sub may include an inner tubular 26 that forms a continuous axial bore 27 from end 22 to end 24. The inner bore may have an inner diameter generally corresponding to the inner diameter of the liner string. For example, as may be appreciated a liner may have a minimum drift diameter to allow tools to pass and the inner tubular may have an inner axial bore that achieves the drift diameter. Drift diameters are often selected according to API standards.

The sub may further include an outer tubular 28 positioned substantially concentrically about inner tubular 26. As will be discussed below, during use the inner tubular is intended to be removed from within the outer tubular, as by cutting through the inner tubular and pulling out of its underlapping position within outer tubular 28. As such, the inner diameter of outer tubular 28 is selected to be larger than the outer diameter of the inner tubular. In particular, the outer tubular is selected with consideration as to the outer diameter of inner tubular 26 such that it can fit into the inner bore of the outer tubular but be slidable therethrough for removal.

Outer tubular 28 extends at least a length L overlapping along inner tubular 26. Outer tubular 28 includes a first, base end 28*a* that is connected to inner tubular 26 and an outboard, upper end 28*b* that is open, for example, unconnected to inner tubular 26. The overlapping length L can be varied as desired. In one embodiment, a length of 2 to 10 feet can be employed. Shorter lengths reduce the cost of the tool and are easier to accommodate. Longer lengths are easier to locate and may allow for a longer length of the outer tubular to be exposed after removing the inner tubular such that is easier to fit and seal into.

Tubulars 26, 28 can be connected together in various ways as by threading the tubulars together using, for example, a two-sided threaded connector 31. Of course other options are possible such as by forming the parts, welding the parts, etc. Seals 33, such as o-rings, may be provided to enhance the pressure holding capabilities of the connections.

Outer tubular 28 may take various forms, for example, one embodiment may include one or more connection structures for permitting connection to a wellbore tubular string. For example, outer tubular may include a polish bore receptacle 32 for example on its inner diameter. As will be appreciated, a polish bore may be used to provide a sealing surface against which external annular seals on a tubular can be seated. Alternately or in addition, outer tubular 28 may include a connection structure such as a threaded or interlocking interval 34.

Sub 20 can be secured in line with a tubular string and installed with the string down hole. In so doing, tubulars will be secured at ends 22, 24. The sub will function as any other tubular in the string with inner tubular acting to line the borehole and as such, for example, acting to provide a conduit for conveying fluids and/or to allow the passage of tools or other strings. When the inner tubular is acting to line the borehole, outer tubular 28 is out of fluid communication with the axial bore of the inner tubular and at least the outer surface of the outer tubular is open to the annulus about the liner string. The inner facing surface may be open to the annulus as well, but may alternately be packed with materials to prevent damage to the connection structures. Such packing may be easily removed, such as where the packing includes grease, etc.

In use, if access to the open hole is desired, inner tubular 26 of the sub may be cut to allow upper end 24 of the inner tubular to be separated from the lower end thereof. Any such cut may be made such that at least a portion of inner tubular 26 is removed from within outer tubular to expose at least a portion of the connection structures (i.e. polish bore 32 or connection interval 34) of the outer tubular. The separated upper portion of inner tubular 26 can be removed from the well. With the removal of the upper portion of inner tubular 26, the open hole can be accessed above the remaining portion of sub 20 and, for example, lateral wellbores, item 18 of FIG. 1, may be formed through that portion of the open hole.

To provide well control, production, isolation or treatments of the lined wellbore below sub 20, a connection can be made into the remaining upwardly opening outer tubular 28. For example, an apparatus such as a plug, a sub, or a string such as of tubulars, coiled tubing, etc. can be landed on the outboard end of the outer tubular and, for example, such apparatus can be installed in outer tubular 28, sealed against polish bore 32 and/or engaged in interval 34.

In order to facilitate appropriate positioning of any cut along inner tubular 26, a profile 36 may be formed along or below the inner tubular such that a positioning portion of the cutting device may be landed in the profile with a cutting mechanism spaced a set distance from the positioning portion. Profile 36 may be useful for tool locating and may for example include one or more glands, such as annular indentations having an inner diameter larger than that of the axial bore and into which a dog or resilient member on a tool can drop and become secured. In one embodiment, as shown, the profile can be positioned below a location to be cut, generally indicated by reference numeral 35. For example, profile 36 can be located in axial bore 27 below the connection point 31 of outer tubular 28 and inner tubular 26.

The cutting mechanism may include chemical cutters, explosive cutting devices, jetting cutters and abrasive mechanical cutters, such as using carbide cutters. Such cutter mechanisms may cut through inner tubular so that it can be removed. During such cutting, the outer tubular may be abraded, but care may be taken to select a cutting procedure that does not cut the outer tubular through.

In order to limit the outer diameter of the sub at the overlapping portion between inner tubular 26 and outer tubular 28, the inner tubular and/or the outer tubular at least along the overlapping length may be formed of thinner walled tubular stock than some other tubulars along the string. In one embodiment, the inner tubular wall thickness may vary along the length from end 22 to end 24. For example, the portion of the inner tubular below connection point 31 to outer tubular 28 may have a wall thickness that is thicker than that portion of inner tubular 26 that is overlapped by the outer tubular.

In addition, the tubular construction and/or arrangement may be selected to allow cutting removal of the inner tubular without cutting through the outer tubular. In one embodiment for example, the ability to cut inner tubular 26 may be enhanced by provision of a tubular that has walls thinner than other standard tubulars used in liners. In another embodiment, as illustrated, an annular space 30 can remain between the tubulars, leaving space for the cutters to pass through the inner tubular without immediately cutting into the outer tubular. Alternately or in addition, the materials of the tubulars can be selected to allow the inner tubular to be cut without also cutting through the outer tubular. Of course, any tubulars employed in the sub may be durable enough to withstand downhole conditions for extended periods.

As may be appreciated, for ease of manufacture, the sub may be formed by a plurality of tubular sections threaded or otherwise connected together. Lower torque connections may employ set screws.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower portion of the inner tubular; and removing the upper portion from the well to expose the open hole above the upper end of the outer tubular.

2. The method of claim 1 wherein the cuttable portion is installed in a sub secured in line with the liner segment and installed with the liner segment downhole.

3. The method of claim 1 wherein prior to cutting the inner tubular, the inner tubular functions to line the wellbore along the liner segment.

4. The method of claim 1 wherein prior to cutting the inner tubular, the outer tubular is out of fluid communication with an inner bore of the inner tubular.

5. The method of claim 1 wherein the outer tubular includes a connection structure and cutting the inner tubular and removing the upper portion of the inner tubular exposes at least a portion of the connection structure.

6. The method of claim 1 wherein the upper portion of the inner tubular is removed from the well.

7. The method of claim 1 further comprising drilling a lateral wellbore into the open hole.

8. The method of claim 1 further comprising providing at least one of well control, production, isolation or treatments through the liner segment below the lower portion of the inner tubular.

9. The method of claim 1 further comprising landing an apparatus on the outer tubular to provide access to the liner segment below the lower portion.

10. The method of claim 1 wherein cutting includes locating a positioning portion of a cutting device in a locating profile to position a cutting mechanism of the cutting device a set distance from the locating profile.

11. A tubular member for lining a wellbore, the tubular member comprising: an inner tubular member including a first end, an opposite end, an axial bore extending from the first end to the opposite end and an outer surface; an outer tubular including a base end and an outboard end, the outer tubular connected about the inner tubular adjacent its base end; an annular space between the inner tubular member and the outer tubular and the outer tubular being open and unconnected to the inner tubular member at the outboard end to provide access to the annular space; and a locating profile in the axial bore of the inner tubular member.

12. The tubular member of claim 11 wherein the inner tubular member first end and opposite end are formed as threaded connectors for installation to a wellbore liner string.

13. The tubular member of claim 11 wherein the axial bore defines a minimum drift diameter according to a wellbore liner string.

14. The tubular member of claim 11 wherein the outer tubular is selected with consideration as to the outer diameter of the inner tubular member such that the inner tubular member can fit into the outer tubular but be slidable therethrough for removal.

15. The tubular member of claim 11 wherein the outer tubular extends at least a length overlapping along the inner tubular member.

16. The tubular member of claim 11 wherein the outer tubular includes a connection structure for permitting connection to a wellbore tubular string.

17. The tubular member of claim 16 wherein the connection structure includes a polish bore receptacle.

18. The tubular member of claim 16 wherein the connection structure includes a threaded or interlocking interval.

19. The tubular member of claim 11 wherein locating profile includes at least one gland having an increased inner diameter over that of the axial bore.

20. A tubular member for lining a wellbore, the tubular member comprising: an inner tubular including a first end, an opposite end, an outer surface and an axial bore extending from the first end to the opposite end, the axial bore defining a minimum drift diameter according to a wellbore liner string and; an outer tubular including a base end and an outboard end, the outer tubular connected about the inner tubular adjacent its base end; and a locating profile in the axial bore of the inner tubular.

21. The tubular member of claim 20 wherein the inner tubular first end and opposite end are formed as threaded connectors for installation to a wellbore liner string.

22. The tubular member of claim 20 wherein the outer tubular is selected with consideration as to the outer diameter of the inner tubular such that the inner tubular can fit into the outer tubular but be slidable therethrough for removal.

23. The tubular member of claim 20 wherein the outer tubular extends at least a length overlapping along the inner tubular.

24. The tubular member of claim 20 wherein the outer tubular includes a a polish bore receptacle for permitting connection to a wellbore tubular string.

25. The tubular member of claim 24 further comprising a threaded or interlocking interval adjacent the polished bore receptacle.

26. The tubular member of claim 20 wherein locating profile includes at least one gland having an increased inner diameter over that of the axial bore.

27. The tubular member of claim 20 further comprising an annular space between the inner tubular and the outer tubular.

28. A tubular member for lining a wellbore, the tubular member comprising: an inner tubular including a first end, an opposite end, an axial bore extending from the first end to the opposite end and an outer surface; an outer tubular including a base end, an outboard end and a polish bore receptacle for permitting connection to a wellbore tubular string, the outer tubular connected about the inner tubular adjacent its base end and a locating profile in the axial bore of the inner tubular.

29. The tubular member of claim 28 wherein the inner tubular first end and opposite end are formed as threaded connectors for installation to a wellbore liner string.

30. The tubular member of claim 28 wherein the outer tubular is selected with consideration as to the outer diameter of the inner tubular such that the inner tubular can fit into the outer tubular but be slidable therethrough for removal.

31. The tubular member of claim 28 wherein the outer tubular extends at least a length overlapping along the inner tubular.

32. The tubular member of claim 28 further comprising a threaded or interlocking interval adjacent the polished bore receptacle.

33. The tubular member of claim 28 wherein locating profile includes at least one gland having an increased inner diameter over that of the axial bore.

34. The tubular member of claim 28 further comprising an annular space between the inner tubular and the outer tubular.

35. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower portion of the inner tubular; and removing the upper portion from the well to expose the wellbore behind the inner tubular above the upper end of the outer tubular, wherein the cuttable portion is installed in a sub secured in line with the liner segment and installed with the liner segment downhole.

36. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower portion of the inner tubular; and removing the upper portion from the well to expose the wellbore behind the inner tubular above the upper end of the outer tubular, wherein prior to cutting the inner tubular, the inner tubular functions to line the wellbore along the liner segment.

37. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower portion of the inner tubular; and removing the upper portion from the well to expose the wellbore behind the inner tubular above the upper end of the outer tubular, wherein prior to cutting the inner tubular, the outer tubular is out of fluid communication with an inner bore of the inner tubular.

38. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end and the outer tubular including a connection structure; cutting the inner tubular to separate an upper portion from a lower portion thereof, at a position overlapped by the outer tubular and adjacent the lower portion of the inner tubular; and removing the upper portion from the well to expose the wellbore behind the inner tubular above the upper end of the outer tubular and to expose at least a portion of the connection structure.

39. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower portion of the inner tubular; and removing the upper portion from the well to expose the wellbore behind the inner tubular above the upper end of the outer tubular; and drilling a lateral wellbore into the open hole.

40. A method for removing a liner segment in a wellbore, the method comprising: providing along the liner a cuttable portion including an inner tubular and an outer tubular positioned concentrically about the inner tubular, the outer tubular connected to the inner tubular adjacent a lower end and open at its upper end; cutting the inner tubular to separate an upper portion from a lower portion thereof, at a position overlapped by the outer tubular and adjacent the lower portion of the inner tubular; removing the upper portion from the well to expose the wellbore behind the inner tubular above the upper end of the outer tubular; and further comprising landing an apparatus on the outer tubular to provide access to the liner segment below the lower portion.

* * * * *